US007763138B2

(12) United States Patent
Pfitzner et al.

(10) Patent No.: US 7,763,138 B2
(45) **Date of Patent: *Jul. 27, 2010**

(54) AUTO LAMINATION CASSETTE APPARATUS AND PROCESS

(75) Inventors: Gary Pfitzner, Issaquah, WA (US); Donald Anderson, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 582 days.

This patent is subject to a terminal disclaimer.

(21) Appl. No.: 11/751,504

(22) Filed: May 21, 2007

(65) Prior Publication Data

US 2008/0289746 A1 Nov. 27, 2008

(51) Int. Cl.
*B32B 37/00* (2006.01)
*B32B 38/10* (2006.01)
*B32B 38/04* (2006.01)

(52) U.S. Cl. ..... 156/247; 156/248; 156/267; 156/289; 156/344

(58) Field of Classification Search ..... 156/166, 156/169, 174, 184, 247–250, 267, 268, 289, 156/344, 391, 510, 537, 538, 584
See application file for complete search history.

(56) References Cited

U.S. PATENT DOCUMENTS 5,402,962 A 4/1995 Blaimschein
5,480,508 A * 1/1996 Manabe et al. ..... 156/353
6,299,945 B1 * 10/2001 Mertz et al. ..... 427/503
7,013,943 B2 3/2006 Sana et al.
7,160,594 B2 * 1/2007 Wieck et al. ..... 428/40.1

OTHER PUBLICATIONS

Chawla, Krishan K.; "Composite Materials, Science and Engineering" Second Edition 1998; p. 138.

* cited by examiner

*Primary Examiner*—Philip C Tucker
*Assistant Examiner*—Sing P Chan
(74) *Attorney, Agent, or Firm*—Klintworth & Rozenblat IP LLC

(57) ABSTRACT

In one embodiment of the disclosure, an apparatus is provided for preparing a cassette spool. The apparatus includes: a supply reel for supplying and unrolling tape material on original backing paper; at least one cutting member for cutting unrolled tape material while on original backing paper; at least one removing member for removing uncut unrolled tape material from original backing paper; an identification member for identifying on unrolled original backing paper a start of unrolled cut tape material; and a cassette spool for rolling up unrolled cut tape material on original backing paper. In further embodiments, methods are provided for preparing a cassette spool with cut tape material on original backing paper.

12 Claims, 4 Drawing Sheets

AUTO LAMINATION CASSETTE APPARATUS AND PROCESS

BACKGROUND

Many apparatus and methods exist for automatically preparing cassette spools wound with tape material on original backing paper. This tape material may be used to form a laminate. In one existing apparatus/method, tape material on backing paper is unrolled from a supply reel, the tape material is cut into the required configuration, removed from the original backing paper, and then transferred to another release backing paper and wound onto a cassette spool. However, the transferring of the tape material to another backing paper may create problems. The tape material may lose some of its tacking ability, may not align as well on the new backing paper, may not adhere well to the new backing paper, and may have placement problems when placed on a working surface. Further, the new backing paper may have a certain amount of stretch which may cause tension problems, may form wrinkles when the tape is placed onto a working surface, and/or may not allow good tacking of the tape material onto the working surface. This may cause problems with tape lifting from the working surface, or may cause wrinkles to be formed in the laminate being formed with the tape material. Moreover, the process of putting the tape material onto a new backing paper may require an excessive number of machines, may increase the costs, may increase the time required, may reduce efficiency, and/or may lead to one or more other problems.

An apparatus, and/or method for preparing a cassette spool, is needed to decrease one or more problems associated with one or more of the existing apparatus and/or methods.

SUMMARY

In one aspect of the disclosure, a method is provided for preparing a cassette spool. In one step, a tape material on an original backing paper is unrolled from a supply reel. In another step, a portion of the unrolled tape material is cut while the unrolled tape material is still on the original backing paper. In still another step, an uncut portion of the unrolled tape material is removed from the original backing paper. In yet another step, an identification is made on the original unrolled backing paper of a start of the portion of cut unrolled tape material. In an additional step, the cut portion of unrolled tape material still on the original backing paper is rolled onto the cassette spool.

In another aspect of the disclosure, an apparatus is provided for preparing a cassette spool. The apparatus comprises: a supply reel for supplying and unrolling tape material on original backing paper; at least one cutting member for cutting unrolled tape material while on original backing paper; at least one removing member for removing uncut unrolled tape material from original backing paper; an identification member for identifying on unrolled original backing paper a start of unrolled cut tape material; and a cassette spool for rolling up unrolled cut tape material on original backing paper.

In a further aspect of the disclosure, a cassette spool is provided which is wound with cut tape material on original backing paper. The cassette spool was prepared by unrolling the tape material, before it was cut, on the original backing paper from a supply reel. A portion of the unrolled tape material was cut while still on the original backing paper. An uncut portion of the unrolled tape material was removed from the original backing paper. An identification was made on the unrolled original backing paper of a start of the portion of cut unrolled tape material. The cut portion of unrolled tape material, while still on the original backing paper, was rolled onto the cassette spool.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
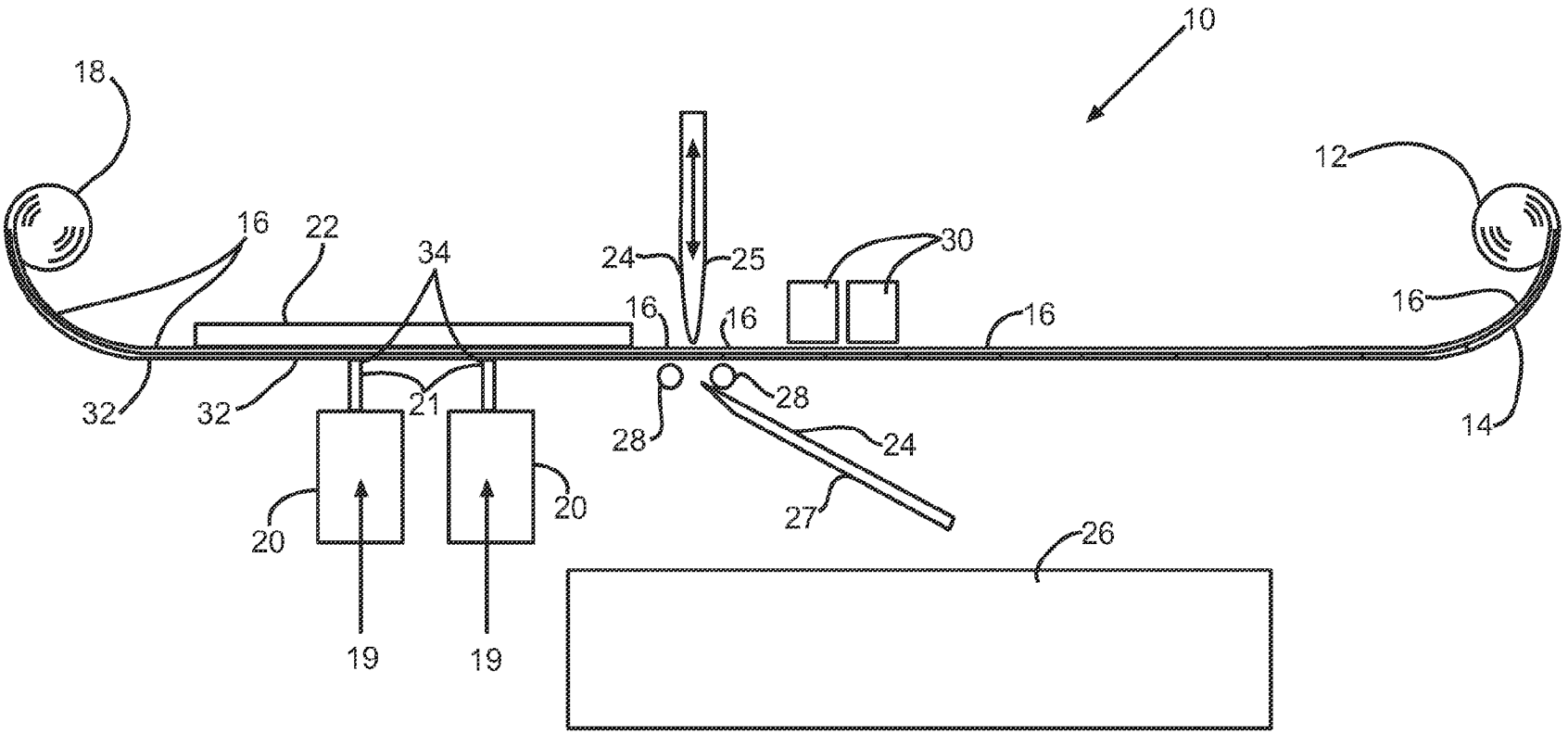
FIG. 1 shows a front view of one embodiment of an apparatus for preparing/processing a cassette spool with cutting members cutting tape material on original backing paper while removing members are disposed away from the tape material.

FIG. 1 shows a front view of one embodiment of an apparatus 10 for preparing/processing a cassette spool 12 with cut tape material 14 on original backing paper 16 wound around the cassette spool 12. The apparatus 10 may comprise a supply reel 18, one or more cutting members 20, a platen 22, one or more removing members 24, a scrap bin 26, one or more rolling members 28, an identification member 30, and the cassette spool 12. The supply reel 18 may be adapted to supply and unroll uncut tape material 32 which is on original backing paper 16 and wound around the supply reel 18. In one embodiment, the unrolled uncut tape material 32 may be 1.5 inches to 12 inches wide. In other embodiments, the unrolled uncut tape material 32 may be of varying shapes, sizes, and configurations.

In FIG. 1, the one or more cutting members 20, which may each comprise at least one sharp cutting edge 21, are shown in positions disposed against tape material 32 which is still on original backing paper 16. In other embodiments, the one or more cutting members 20 may comprise a blade, a knife such as an ultrasonic knife, a stylus knife, or other type of knife. In these or other positions, the one or more cutting members 20 are adapted to cut a portion 34 of the tape material 32 in a pre-determined configuration while it is still on the original backing paper 16, without cutting off the original backing paper 16 from the cut portion 34. The platen 22 may be disposed adjacent the one or more cutting members 20, and may be adapted to be pressed against the original backing paper 16 as the one or more cutting members 20 cut portion 34 of the tape material 32.

Figure 2:
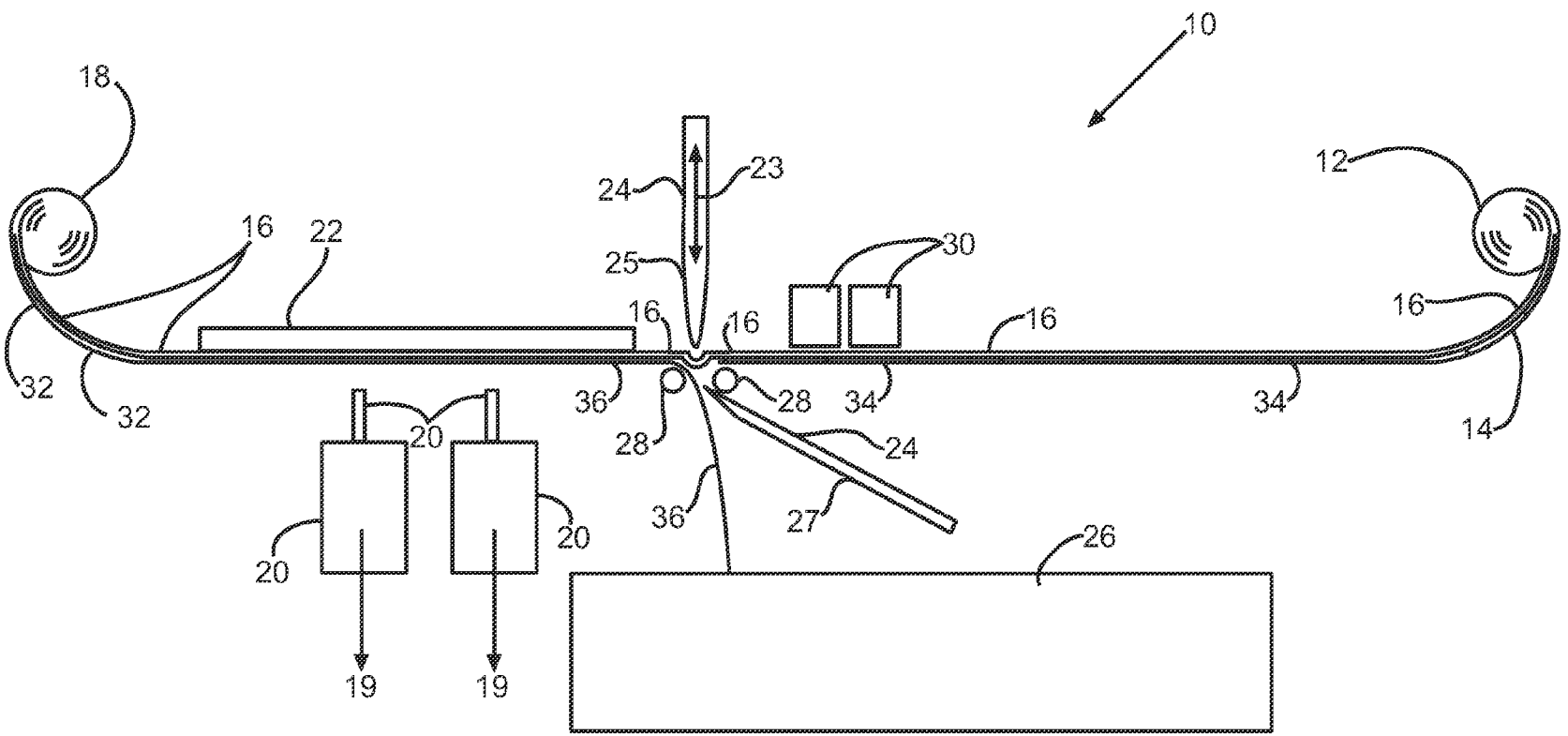
FIG. 2 shows a front view of the embodiment of FIG. 1 with the cutting members disposed away from the tape material and the removing members removing uncut tape material from the original backing paper.

As shown in FIG. 2, after cutting portion 34, the cutting members 20 are adapted to be moved downwardly along direction 19 in order to disengage from cut portion 34. This may allow another portion 36 of the tape material 32, with the original backing paper 16 still on it, to pass by the cutting members 20 without being cut. Subsequently, the cutting members 20 may be adapted to be moved upwardly and downwardly along direction 19 at various times in order to engage and disengage from tape material 32 in order to selectively cut portions 34 and selectively not cut portions 36.

The one or more removing members 24 may comprise a first removing member 25, which may comprise a removal bar, and a second removing member 27, which may comprise a scrap bar, blade, plate, or other type of removing member. In other embodiments, varying numbers, sizes, types, and configurations of removing members 24 may be utilized. As shown in FIG. 1, the first removing member 25 may be put into an upward position disengaged from the original backing paper 16 to allow the cut portion 34 to pass by the first and second removing members 25 and 27 without the cut portion 34 being removed from the original backing paper 16.

As shown in FIG. 2, the first removing member 25 may also be moved downwardly along direction 23 to be put into a position where it engages the original backing paper 16 to force the uncut portion 36 of tape material 32 against the second removing member 27. In this position, the uncut portion 36 of the tape material 32 may be removed from the original backing paper 16 due to the distortion of the original backing paper 16 allowing the second removing member 27 to be forced in-between the uncut portion 36 of the tape material 32 and the original backing paper 16 to allow separation of the uncut portion 36 from the original backing paper 16. In such manner, when in the position shown in FIG. 2, the one or more removing members 24 may be adapted to remove uncut unrolled tape material 36 from the original backing paper 16, while when in the position shown in FIG. 1, the one or more removing members 24 may be adapted to leave the cut portion 34 of tape material 14 on the original backing paper 16. Thereafter, the first removing member 25 may be adapted to be moved downwardly and upwardly along direction 23 at various times in order to selectively remove non-cut portions 36 from the original backing paper 16, and in order to selectively not remove cut portions 34 from the original backing paper 16.

The one or more rolling members 28 may be adapted to be pressed against both the cut portion 34 of tape material 14, and the uncut unrolled tape material 36. The scrap bin 26 may be adapted to hold the removed uncut portion 36 of tape material 32, which may be directed into the scrap bin 26 by the second removing member 27. The identification member 30, which may comprise a hole punch, a marking device, or other type of identification member, may be adapted to identify, on the original backing paper 16, a start of the cut portion 34 of tape material 14 after it has passed by the first and second removing members 25 and 27. For instance, a hole may be punched in, or a mark may be made on the original backing paper 16 to signify the start of cut portion 34 of tape material 14. The cassette spool 12 may be adapted to roll up the cut portion 34 of tape material 14 on the original backing paper 16. After the cut portion 34 of tape material 14 on the original backing paper 16 has been rolled onto the cassette spool 12, the identification marks on the original backing paper 16, made by the identification member 30, may allow a user of the cassette spool 12 to know where the cut portion 34 begins. In such manner, the cut portion 34 of tape material 14 of the cassette spool 12 may subsequently be unrolled from the cassette spool 12 in the appropriate location on a working surface.

Figure 3:
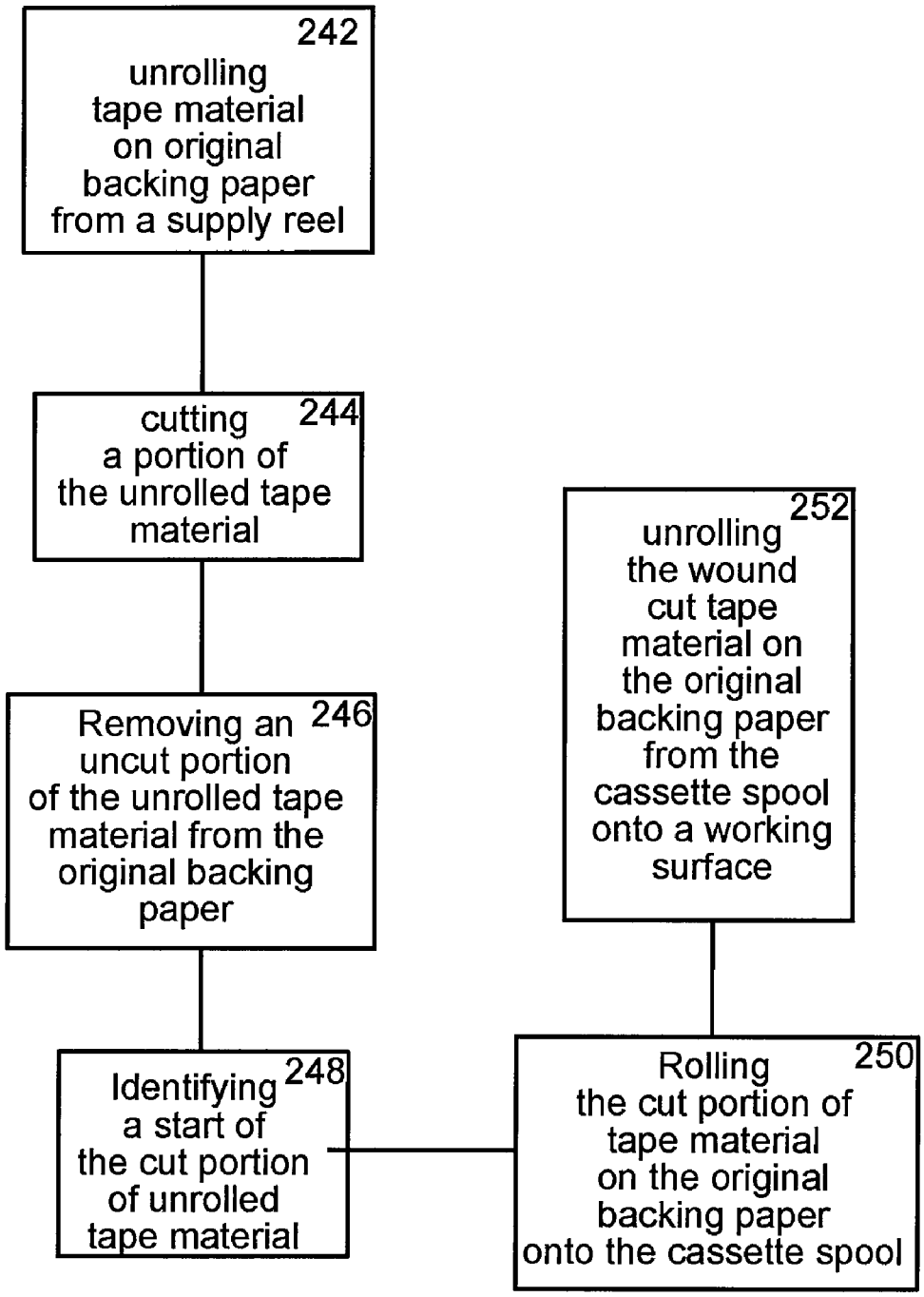
FIG. 3 is a flowchart showing one embodiment of a method for preparing a cassette spool with cut tape material on original backing paper wound around the cassette spool.

FIG. 3 shows a flowchart 240 of an embodiment of a method for preparing a cassette spool 12 with cut tape material 14 on original backing paper 16 wound around the cassette spool 12. In one embodiment, the tape material 14 may comprise composite tape. In another embodiment, the tape material 14 may comprise unidirectional composite tape made of Kevlar, Graphite, Fiberglass, or other type of material. In one embodiment, the original backing paper 16 may comprise a polymeric matrix material made of Paper, Polyster, Mylar, Tedlar, Polyurethane, or other type of material, such as a paper coated with a release material. In one step 242, tape material 32 on original backing paper 16 may be unrolled from a supply reel 18.

In another step 244, a portion 34 of the unrolled tape material 32, which may still be on the original backing paper 16, may be cut. In one embodiment, this step 244 may comprise cutting the portion 34 of unrolled tape material 32 using a cutting member 20 having a sharp edge 21, while the original backing paper 16 is against the platen 22. In yet another step 246, an uncut portion 36 of the unrolled tape material 32 may be removed from the original backing paper 16. In one embodiment, this step 246 may comprise pressing a first removing member 25 against the original backing paper 16 in order to force the uncut portion 36 of the unrolled tape material 32 against a second removing member 27 in order to remove the uncut portion 36 of the unrolled tape material 32 from the original backing paper 16. This step 246 may also comprise pressing the uncut portion 36 of the unrolled tape material 32 against one or more rolling members 28. In still another embodiment, this step 246 may further comprise placing the removed uncut portion 36 of the unrolled tape material 32 into a scrap bin 26.

In still another step 248, a start of the portion 34 of cut unrolled tape material 32 may be identified on the original backing paper 16. In one embodiment, this step 248 may comprise using at least one of a hole punch, a marking device, such as a pen, or other identifying device to identify on the original unrolled backing paper 16 the start of the cut portion 34. In an additional step 250, the cut portion 34 of unrolled tape material 32, which may still be on the original backing paper 16, may be rolled onto the cassette spool 12 to form wound cut tape material 14. Another step 252 may comprise unrolling the wound cut tape material 14, still on the original backing paper 16, from the cassette spool 12 to place the cut portion 34 of tape material 14 onto a working surface using a flat tape placement machine, a contoured tape laminating machine, or other type of tape placement machine.

In still another embodiment, a cassette spool 12 wound with cut tape material 14 on original backing paper 16 may be provided. The cut tape material 14 may comprise composite tape, while the original backing paper 16 may comprise polymeric matrix material, or other material, such as paper coated with a release material. In other embodiments, varying materials may be used. The cassette spool 12 may have been prepared by unrolling the tape material 32, before it was cut, on the original backing paper 16 from a supply reel 18. A portion 34 of the unrolled tape material 32 may have been cut while still on the original backing paper 16. An uncut portion 36 of the unrolled tape material 32 may have been removed from the original backing paper 16. An identification may have been made, on the unrolled original backing paper 16, of a start of the portion 34 of cut unrolled tape material 32. The cut portion 34 of unrolled tape material 32 may have been rolled, while still on the original backing paper 16, onto the cassette spool 12 to form wound cut tape material 14.

One or more embodiment of the disclosure may reduce and/or eliminate one or more problems which may have been experienced by one or more of the existing apparatus or methods. For instance, one or more embodiments of the disclosure may reduce the numbers and amounts of backing paper needed, may reduce costs, may reduce the number of machines required, may substantially reduce time since the process may be carried out without transferring cut tape to new backing paper, may lead to less wrinkling and/or tension in the tape material against the backing paper since new backing paper is not required, may improve the adherence of the cut tape to the backing paper since new backing paper is not required, may reduce tacking problems, may reduce problems in transferring tape resin to new backing paper, may improve efficiency, may be less complex, may be more reliable, may be more accurate, may make it less difficult to place tape against working surfaces by providing improved tracking and guidance, may reduce tape lifting from working surfaces, and/or may reduce and/or eliminate one or more other types of problems in one or more of the existing apparatus and/or methods.

Figure 4:
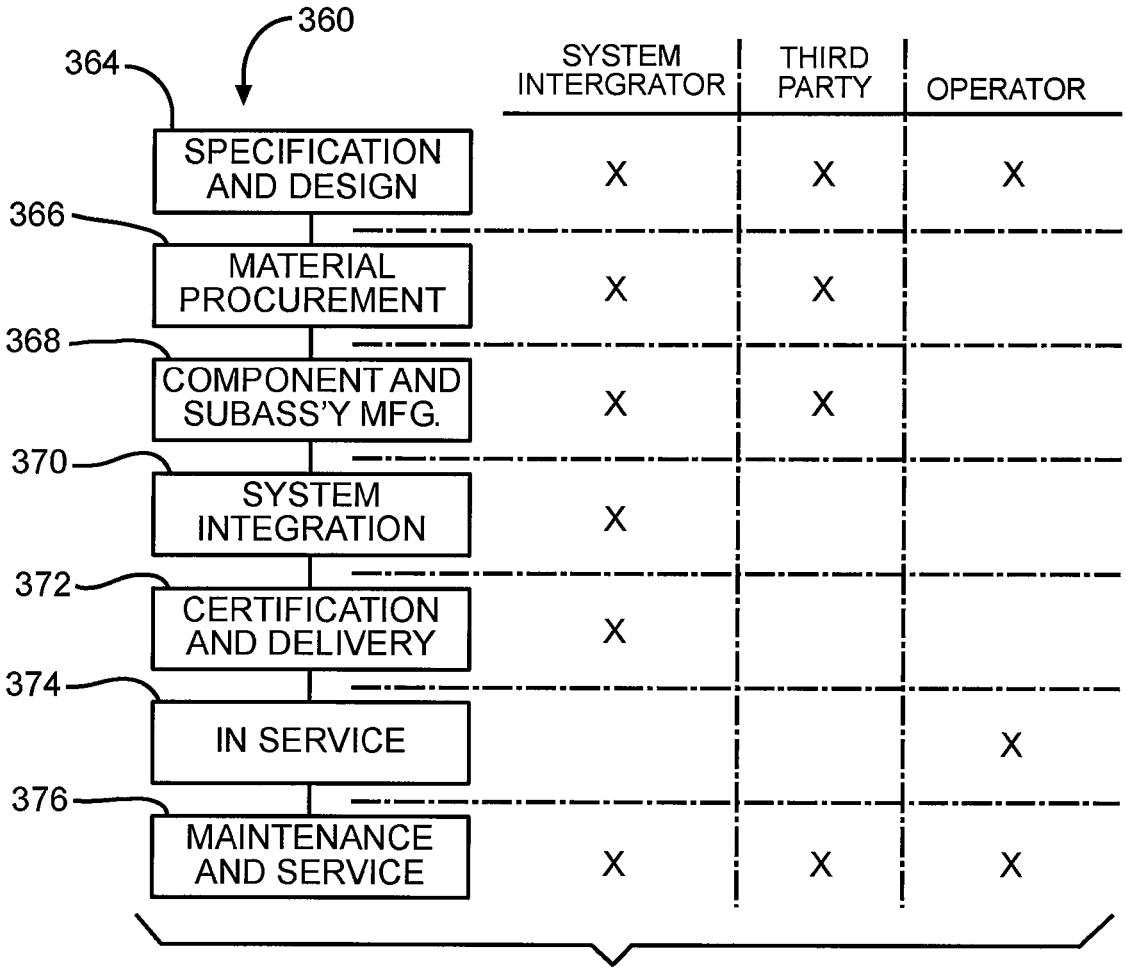
FIG. 4 is a flow diagram of an aircraft production and service method.
Figure 5:
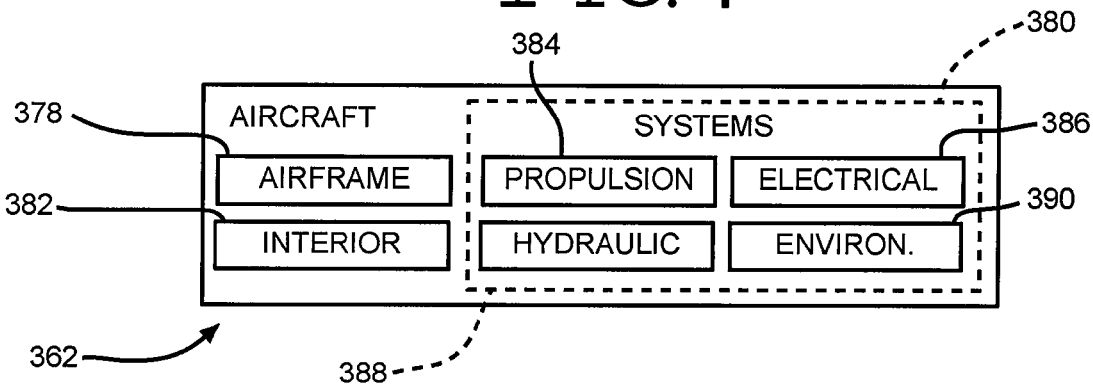
FIG. 5 is a block diagram of an aircraft.

Embodiments of the disclosure may be described in the context of an aircraft manufacturing and service method 300 as shown in FIG. 4 and an aircraft 362 as shown in FIG. 5. During pre-production, exemplary method 360 may include specification and design 364 of the aircraft 362 and material procurement 366. During production, component and subassembly manufacturing 368 and system integration 370 of the aircraft 362 takes place. Thereafter, the aircraft 362 may go through certification and delivery 372 in order to be placed in service 374. While in service by a customer, the aircraft 362 is scheduled for routine maintenance and service 376 (which may include modification, reconfiguration, refurbishment, and so on).

Each of the processes of method 360 may be performed or carried out by a system integrator, a third party, and/or an operator (e.g., a customer), as indicated by the "X" in the grid to the right of the flow diagram of FIG. 4. For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 5, the aircraft 362 produced by exemplary method 360 may include an airframe 378 with a plurality of systems 380 and an interior 382. Examples of high-level systems 380 include one or more of a propulsion system 384, an electrical system 386, a hydraulic system 388, and an environmental system 390.

Apparatus and methods embodied herein may be employed during any one or more of the stages of the production and service method 360. For example, components or subassemblies corresponding to production process 368 may be fabricated or manufactured in a manner similar to components or subassemblies produced while the aircraft 362 is in service. Also, one or more apparatus embodiments, method embodiments, or a combination thereof may be utilized during the production stages 368 and 370, for example, by substantially expediting assembly of or reducing the cost of an aircraft 362. Similarly, one or more of apparatus embodiments, method embodiments, or a combination thereof may be utilized while the aircraft 362 is in service, for example and without limitation, to maintenance and service 376.

It should be understood, of course, that the foregoing relates to exemplary embodiments of the disclosure and that modifications may be made without departing from the spirit and scope of the disclosure as set forth in the following claims.

The invention claimed is:

1. A method of preparing a cassette spool comprising:

unrolling a tape material on an original backing paper from a supply reel;

cutting a portion of the unrolled tape material while the unrolled tape material is still on said original backing paper;

removing an uncut portion of the unrolled tape material from said original backing paper by moving a first removing member against the original backing paper forcing the uncut portion of the unrolled tape material between rolling members against a second removing member to remove the uncut portion of the unrolled tape material from said original backing paper;

identifying on the original unrolled backing paper a start of the portion of cut unrolled tape material; and rolling the cut portion of unrolled tape material still on said original backing paper onto said cassette spool.

2. The method of claim 1 further comprising the step of unrolling the cut portion of tape material still on said original backing paper from said cassette spool onto a working surface using at least one of a flat tape placement machine and a contoured tape laminating machine.

3. The method of claim 1 wherein said tape material comprises composite tape.

4. The method of claim 3 wherein said tape material comprises unidirectional composite tape.

5. The method of claim 1 wherein the original backing paper comprises at least one of a polymeric matrix material and paper that is coated with a release material.

6. The method of claim 1 wherein the cutting step comprises cutting said portion of the unrolled tape material using a cutting member having a sharp cutting edge.

7. The method of claim 6 wherein the cutting step comprises cutting said portion of the unrolled tape material with said sharp cutting edge of said cutting member while said original backing paper is against a platen.

8. The method of claim 1 wherein the first removing member comprises a moving removal bar, and the second removing member comprises one of a group comprising: a scrap bar, a blade, and a plate, wherein the second removing member is fixed in place between the rolling members.

9. The method of claim 1 further comprising moving the first removing member away from the original backing paper after the uncut portion of the unrolled tape material has been removed from said original backing paper, and then moving the cut portion of the unrolled tape material on said original backing paper past the first removing member without removing the cut portion of the unrolled tape material from said original backing paper.

10. The method of claim 1 wherein the removing step further comprises the removed uncut portion of the unrolled tape material being directed into a scrap bin by the second removing member.

11. The method of claim 1 wherein the identifying step comprises using at least one of a hole punch, and a marking device to identify on the original unrolled backing paper the start of the portion of cut unrolled tape.

12. The method of claim 1 wherein the method is used during at least one of aircraft pre-production, aircraft production, and aircraft service.

* * * * *